US012013138B2

(12) United States Patent
Blanton

(10) Patent No.: US 12,013,138 B2
(45) Date of Patent: Jun. 18, 2024

(54) WORKING FLUID ELIMINATOR FOR A HEATING, VENTILATION, AND/OR AIR CONDITIONING (HVAC) SYSTEM

(71) Applicant: Johnson Controls Tyco IP Holdings LLP, Milwaukee, WI (US)

(72) Inventor: Norman Jack Blanton, Norman, OK (US)

(73) Assignee: Tyco Fire & Security GmbH, Neuhausen am Rheinfall (CH)

( * ) Notice: Subject to any disclaimer, the term of this patent is extended or adjusted under 35 U.S.C. 154(b) by 0 days.

(21) Appl. No.: 17/834,757

(22) Filed: Jun. 7, 2022

(65) Prior Publication Data

US 2023/0392817 A1 Dec. 7, 2023

(51) Int. Cl.

| | |
|---|---|
| ***F24F 11/84*** | (2018.01) |
| ***F24F 5/00*** | (2006.01) |
| ***F24F 13/20*** | (2006.01) |
| ***F24F 13/30*** | (2006.01) |

(52) U.S. Cl.

CPC ..... *F24F 11/84* (2018.01); *F24F 5/001* (2013.01); *F24F 13/20* (2013.01); *F24F 13/30* (2013.01); *F24F 2013/207* (2013.01)

(58) Field of Classification Search

CPC ..... F24F 11/84; F24F 13/30; F24F 2013/207; F24F 3/20; F24F 5/001

See application file for complete search history.

(56) References Cited

U.S. PATENT DOCUMENTS

| | | | |
|---|---|---|---|
| 5,564,280 | A | 10/1996 | Schilling et al. |
| 2013/0213068 | A1 | 8/2013 | Goel et al. |
| 2018/0327179 | A1 | 11/2018 | Papas et al. |

FOREIGN PATENT DOCUMENTS

| | | | |
|---|---|---|---|
| CA | 3072083 | A1 * | 8/2020 |
| CN | 110553341 | | 9/2020 |
| EP | 0719995 | A2 * | 7/1996 |
| JP | 2010117072 | A * | 5/2010 |
| JP | 5591207 | | 9/2014 |
| KR | 101485350 | | 1/2015 |
| WO | 2013038599 | | 3/2013 |
| WO | WO-2020014679 | A1 * | 1/2020 |

OTHER PUBLICATIONS

Classic Filters, "Catchpots and Drain Vessels for use with Coalescing Filters", Website : https://www.classicfilters.com/blog/catchpots-and-drain-vessels-for-use-with-coalescing-filters/?cn-reloaded=1&cn-reloaded=1 , Feb. 2, 2012, pp. 1-8.

* cited by examiner

*Primary Examiner* — Kun Kai Ma
(74) *Attorney, Agent, or Firm* — Fletcher Yoder, PC

(57) ABSTRACT

A heating, ventilation, and air conditioning (HVAC) system, including a vapor compression circuit configured to circulate a working fluid therethrough to condition a fluid in thermal communication with the vapor compression circuit. A working fluid eliminator is fluidly coupled to the vapor compression circuit. A valve of the working fluid eliminator is adjustable to enable discharge of the working fluid from the vapor compression circuit and through the working fluid eliminator, wherein the valve is communicatively coupled to and controlled by an event controller.

20 Claims, 8 Drawing Sheets

WORKING FLUID ELIMINATOR FOR A HEATING, VENTILATION, AND/OR AIR CONDITIONING (HVAC) SYSTEM

BACKGROUND

This section is intended to introduce the reader to various aspects of art that may be related to various aspects of the present disclosure, which are described below. This discussion is believed to be helpful in providing the reader with background information to facilitate a better understanding of the various aspects of the present disclosure. Accordingly, it should be understood that these statements are to be read in this light, and not as admissions of prior art.

Heating, ventilation, and/or air conditioning (HVAC) systems are utilized in residential, commercial, and industrial environments to control environmental properties, such as temperature, humidity, and/or air quality, for occupants of the respective environments. The HVAC system may regulate the environmental properties through delivery of a conditioned air flow to the environment. For example, the HVAC system may include an HVAC unit (e.g., a heat pump) that is fluidly coupled to various rooms or spaces within the building via an air distribution system, such as a system of ductwork. The HVAC unit includes heat exchangers that cooperate to enable generation of the conditioned air flow (e.g., heated air, cooled air, dehumidified air) and typically includes a fan or blower that is operable to direct the conditioned air flow through the ductwork and into the spaces to be conditioned. In this manner, the HVAC unit facilitates regulation of environmental parameters within the rooms or spaces of the building.

HVAC systems may employ any of various different working fluids (e.g., refrigerants) in a vapor compression cycle to facilitate absorption and expulsion of heat, which allows for temperature control of a conditioned space. The working fluid for a particular HVAC system is generally contained within the system and not directly exposed to the environment during normal operation. As the working fluid circulates through the HVAC system, the working fluid may be repeatedly and alternately compressed (e.g., via a compressor) and expanded (e.g., via an expansion valve) to create state changes in the working fluid. That is, the working fluid may be transitioned between liquid and vapor states to facilitate heat transfer. Indeed, as the state changes occur, heat is absorbed and expelled. Thus, the HVAC system may utilize the vapor compression cycle and positioning of components for expansion and compression such that, for example, heat is absorbed from an indoor environment and expelled to an outdoor environment even though the outdoor environment is at a higher temperature than the indoor environment.

SUMMARY

A summary of certain embodiments disclosed herein is set forth below. It should be noted that these aspects are presented merely to provide the reader with a brief summary of these certain embodiments and that these aspects are not intended to limit the scope of this disclosure. Indeed, this disclosure may encompass a variety of aspects that may not be set forth below.

In an embodiment, a heating, ventilation, and air conditioning (HVAC) system, includes a vapor compression circuit configured to circulate a working fluid therethrough to condition a fluid in thermal communication with the vapor compression circuit. A working fluid eliminator is fluidly coupled to the vapor compression circuit. A valve of the working fluid eliminator is adjustable to enable discharge of the working fluid from the vapor compression circuit and through the working fluid eliminator, wherein the valve is communicatively coupled to an event controller.

In an embodiment, a heating, ventilation, and air conditioning (HVAC) system includes a vapor compression circuit configured to circulate a working fluid therethrough to condition a fluid in thermal communication with the vapor compression circuit. The HVAC system includes a compressor and a heat exchanger of the vapor compression circuit, the heat exchanger positioned downstream of the compressor relative to a flow direction of the working fluid through the vapor compression circuit, and a working fluid eliminator fluidly coupled to the vapor compression circuit downstream of the compressor and upstream of the heat exchanger relative to the flow direction.

In an embodiment, a method of purging working fluid from an HVAC system is provided. The method includes receiving, from an event controller, an electronic input indicative of a request to purge the working fluid from a vapor compression circuit of the HVAC system, the vapor compression circuit comprising a compressor and a heat exchanger downstream of the compressor. Based on the electronic input, the method includes opening a valve of a working fluid eliminator, wherein the valve is positioned in fluid communication with the vapor compression circuit of the HVAC system downstream of the compressor and upstream of the heat exchanger, wherein the working fluid eliminator is a containment working fluid eliminator. Further, based on the electronic input, the method includes closing a blocking valve downstream of the heat exchanger and upstream of the compressor.

BRIEF DESCRIPTION OF THE DRAWINGS

Various aspects of this disclosure may be better understood upon reading the following detailed description and upon reference to the drawings in which.

DETAILED DESCRIPTION

Figure 1:
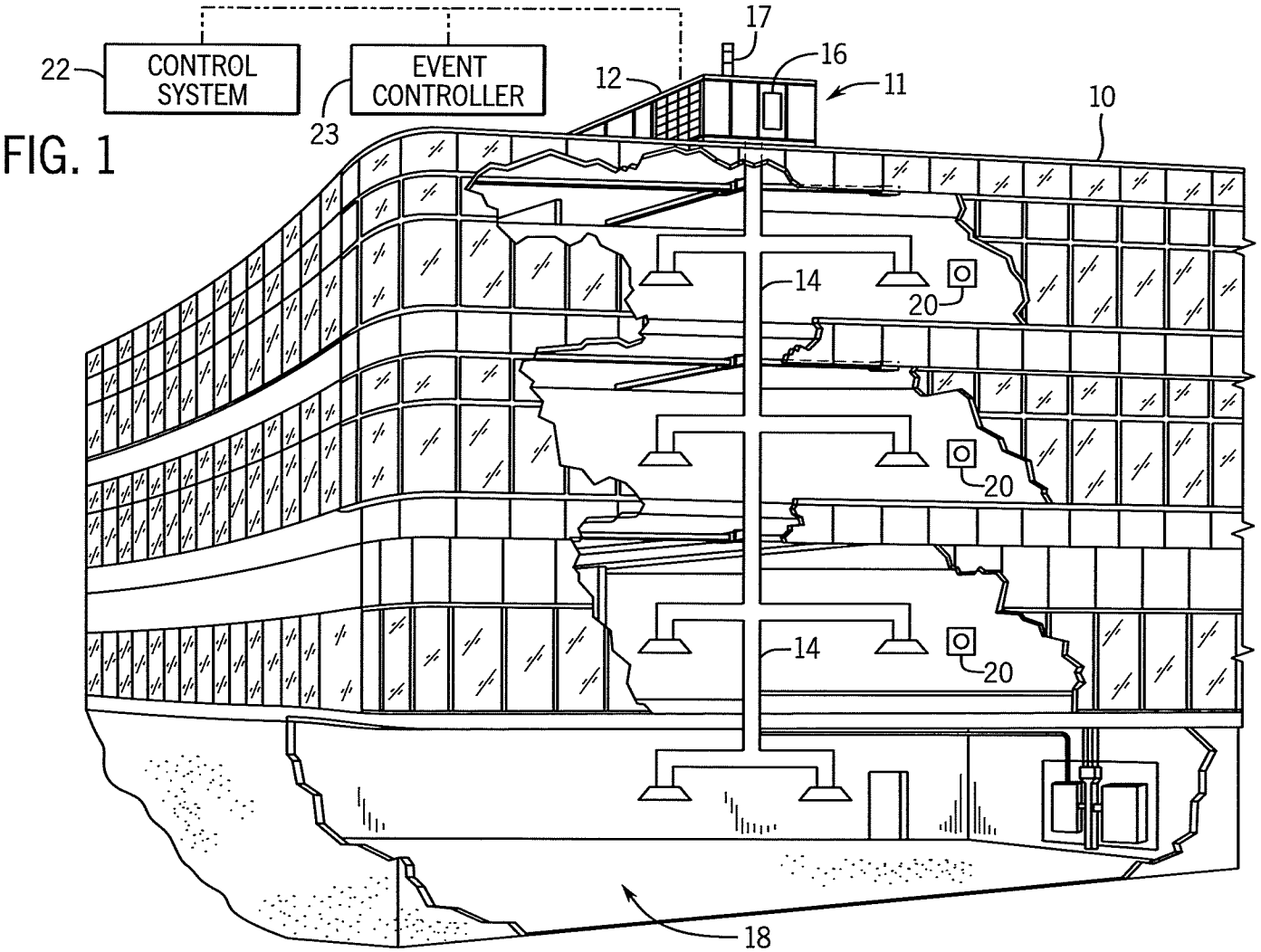
FIG. 1 is a perspective view of an embodiment of a building incorporating a heating, ventilation, and/or air conditioning (HVAC) system, in accordance with an aspect of the present disclosure.

One or more specific embodiments of the present disclosure will be described below. These described embodiments are only examples of the presently disclosed techniques. Additionally, in an effort to provide a concise description of these embodiments, all features of an actual implementation may not be described in the specification. It should be appreciated that in the development of any such actual implementation, as in any engineering or design project, numerous implementation-specific decisions must be made to achieve the developers' specific goals, such as compliance with system-related and business-related constraints, which may vary from one implementation to another. Moreover, it should be appreciated that such a development effort might be complex and time consuming, but would nevertheless be a routine undertaking of design, fabrication, and manufacture for those of ordinary skill having the benefit of this disclosure.

When introducing elements of various embodiments of the present disclosure, the articles "a," "an," and "the" are intended to mean that there are one or more of the elements. The terms "comprising," "including," and "having" are intended to be inclusive and mean that there may be additional elements other than the listed elements. Additionally, it should be understood that references to "one embodiment" or "an embodiment" of the present disclosure are not intended to be interpreted as excluding the existence of additional embodiments that also incorporate the recited features.

A heating, ventilation, and/or air conditioning (HVAC) system may be used to thermally regulate a space within a building, home, or other suitable structure. For example, the HVAC system may include a vapor compression system that transfers thermal energy between a working fluid, such as a refrigerant, and a fluid to be conditioned, such as air. The vapor compression system includes heat exchangers, such as a condenser and an evaporator, which are fluidly coupled to one another via one or more conduits of a refrigerant loop or circuit. A compressor may be used to circulate the refrigerant through the conduits and other components of the refrigerant circuit (e.g., an expansion device) and, thus, enable the transfer of thermal energy between components of the refrigerant circuit (e.g., between the condenser and the evaporator) and one or more thermal loads (e.g., an environmental air flow, a supply air flow). Additionally or alternatively, the HVAC system may include a heat pump having a first heat exchanger (e.g., a heating and/or cooling coil, the evaporator), a second heat exchanger (e.g., a heating and/or cooling coil, the condenser), and a pump (e.g., the compressor) configured to circulate the working fluid (e.g., refrigerant) between the first and second heat exchangers to enable heat transfer between the thermal loads and an ambient environment (e.g., the atmosphere), for example.

Various different working fluids may be utilized in vapor compression cycles of HVAC systems. For example, some HVAC systems may work more efficiently with a particular type of refrigerant. There are numerous types of working fluid available and more are being developed. Indeed recent concerns about the impact of HVAC operations on global warming have spawned interest in creating and utilizing additional working fluids, particularly working fluids with a low Global Warming Potential (GWP). In view of this, it is presently recognized that HVAC systems will be employing working fluids that have properties unlike those of more traditional working fluids. Depending on the nature of working fluids that are eventually employed (e.g., to limit GWP), it is now recognized that it may be desirable to limit exposure to such working fluids (and even existing working fluids). For example, in a damage event (e.g., a fire, earthquake, tornado, hurricane), it will be useful to be able to mitigate the potential for inadvertent release of the working fluid due to a breach in the HVAC system. Accordingly, present embodiments are directed to systems and methods for eliminating working fluid from within the HVAC system to avoid any undesired reactions with surroundings in the event of a breach in the HVAC system and associated release of the working fluid. Specifically, for example, present embodiments include a working fluid eliminator (WFE) incorporated with the vapor compression system of an HVAC system. The WFE may include a venting WFE or a containment WFE (e.g., a combusting WFE, a diluting WFE, and/or a deactivating WFE). In some embodiments, different types of WFEs may be utilized together to efficiently and/or thoroughly eliminate working fluid in response to a damage event or likely damage event. Indeed, a WFE (or multiple WFEs) may be activated by what may be referred to as an event controller or event system (e.g., a firefighter system, fire alarm control panel) that allows for manual activation by authorized personnel (e.g., a firefighter with an appropriate access key or a manager with appropriate credentials in a control system).

A venting WFE may include a vent positioned downstream of a compressor and upstream of a condenser of the vapor compression system. The vent may couple to a conduit that vents to atmosphere above a roofline of a building or structure being conditioned by the associated HVAC system. By positioning the vent downstream of the compressor and upstream of the evaporator, the working fluid can be vented as a vapor or gas with a high pressure differential relative to the atmosphere, which encourages rapid evacuation and a high percentage of working fluid elimination. The venting WFE may include a valve (e.g., releaser, a control valve, relief valve, or portal control that is configured for actuation or operation by the event controller) coupled with or integrated with the vent to allow for managing when working fluid is eliminated from within the HVAC system. Further, valves (e.g., check valves or solenoids) may be positioned along the vapor compression circuit (e.g., located just upstream of the compressor) and operable to facilitate movement of the working fluid out of the system while avoiding back flow through the compressor. A venting WFE may operate to vent directly (e.g., via conduit) to atmosphere when access to the atmosphere is readily available or feasible given practical constraints (e.g., costs). An HVAC system located in a basement or subbasement may not practically allow for atmospheric venting via a venting WFE because of difficulties associated with installing a vent line that can expel into the atmosphere (e.g., outside of a building or structure serviced by the HVAC system).

A containment WFE may be used in any of various circumstances to facilitate elimination of working fluid in advance of or during a damage event. However, a containment WFE may be particularly beneficial when venting to atmosphere is not practical. For example, when certain HVAC components are disposed in a relatively inaccessible location, such as a basement, it may be difficult to vent to atmosphere because conduit would have to be run through the ground and potentially a concrete slab. Inaccessibility such as this may often occur when a retrofit HVAC system is in place in an older building, for example. A containment WFE may be useful in these situations because it provides an alternative manner of eliminating (e.g., diluting, combusting, deactivating) the working fluid without directly venting it.

A containment WFE may include a vent that expels vented working fluid into a vessel to combust the working fluid, dilute the working fluid, and/or deactivate the working fluid. For example, a combusting WFE may, upon actuation of a valve (e.g., a control valve, relief valve, actuation port), vent the working fluid directly into contact with a flame of a burner positioned within a containment vessel. In the present disclosure, the valve may broadly include traditional valves or other release control mechanisms. The burner may be ignited in coordination with initiating release of the working fluid to the combusting WFE. The containment vessel may have an integral accumulator or couple with a separate accumulator vessel to collect liquid or solid combustion products. Gaseous combustion products may be vented (e.g., after filtering via a fine filter, liquid bath, wire mesh, or the like) to atmosphere, a surrounding area, a separate area (e.g., between walls of a structure), or a combination thereof (e.g., various dispersed indoor locations). As another example, a diluting or deactivating WFE may vent the working fluid into a containment vessel along with a deactivating or diluting fluid, such as water (e.g., to dilute the working fluid) and/or a chemical that reacts with the working fluid to make reactive aspects of the working fluid inert. The fluid used for diluting and/or deactivating the working fluid may be stored in a vessel proximate the containment vessel, piped in (e.g., via the water supply system of an associate building) or otherwise supplied (e.g., from condensate collections of the HVAC system) for the designated purpose. Any off-gassing or other gaseous product or result of this dilution/deactivation in the containment vessel may be vented (e.g., after filtering) to a surrounding area (e.g., atmosphere, room, unoccupied space). Any of the various different containment WFE functionalities may be combined in accordance with present embodiments. For example, a containment WFE may initially combust the refrigerant and then dilute the combustion products. This may occur within the same containment vessel or separate containment vessels (e.g., containment vessels in fluid communication in a series arrangement).

It should be noted that the containment WFE may receive venting from a vent positioned downstream of the compressor and upstream of the condenser to facilitate a desired combustion or other interaction. However, it may also be employed with vents from different parts of the system depending on desired results. For example, a large vapor compression system may benefit from using a venting WFE that expels high pressure working fluid (e.g., from downstream of the compressor and upstream of the condenser) to atmosphere in conjunction with a containment WFE on a low pressure side (e.g., downstream of the condenser and upstream of the evaporator) to efficiently expel a high percentage of the working fluid. Further, in some embodiments, it may be beneficial to expel the working fluid in a particular state (e.g., at a lower pressure than immediately downstream of the compressor) into the containment vessel.

Present embodiments may efficiently eliminate (e.g., expel, destroy, deactivate) working fluid (e.g., refrigerant) from an HVAC system by using existing pressure differential within the HVAC system (e.g., without employing any additional pumps or compressors). Further, by employing an event system or event controller (e.g., a firefighter system) for control purposes, present embodiments may avoid undesired venting that will result in replacement costs for eliminated working fluid. Indeed, the event system will require action by an authorized person to initiate operation of a WFE. However, in some embodiments, automation controllers (e.g., a programmable logic controller or distributed control system) may be employed to initiate and monitor operation of a WFE. For example, a fire detection system (or the like) may be a trigger for initiation of operation of a WFE. In other embodiments, the fire detection system (or the like) may prompt an authorized person (e.g., via an alert provided to a primary control system) to initiate operation of the WFE. This may be a prompt that precedes a delayed automatic initiation.

Turning now to the drawings, FIG. 1 illustrates an embodiment of a heating, ventilation, and/or air conditioning (HVAC) system for environmental management that employs one or more HVAC units in accordance with the present disclosure. As used herein, an HVAC system includes any number of components configured to enable regulation of parameters related to climate characteristics, such as temperature, humidity, air flow, pressure, air quality, and so forth. For example, an "HVAC system" as used herein is defined as conventionally understood and as further described herein. Components or parts of an "HVAC system" may include, but are not limited to, all, some of, or individual parts such as a heat exchanger, a heater, an air flow control device, such as a fan, a sensor configured to detect a climate characteristic or operating parameter, a filter, a control device configured to regulate operation of an HVAC system component, a component configured to enable regulation of climate characteristics, or a combination thereof. An "HVAC system" is a system configured to provide such functions as heating, cooling, ventilation, dehumidification, pressurization, refrigeration, filtration, or any combination thereof. The embodiments described herein may be utilized in a variety of applications to control climate characteristics, such as residential, commercial, industrial, transportation, or other applications where climate control is desired.

In the illustrated embodiment, a building 10 is air conditioned by an HVAC system 11 that includes an HVAC unit 12. The building 10 may be a commercial structure or a residential structure. As shown, the HVAC unit 12 is disposed on the roof of the building 10; however, the HVAC unit 12 may be located in other equipment rooms or areas adjacent the building 10. The HVAC unit 12 may be a single package unit containing other equipment, such as a blower, integrated air handler, a heat pump, and/or an auxiliary heating unit.

The HVAC unit 12 may include an air cooled device that implements a refrigeration cycle to provide conditioned air to the building 10. Specifically, the HVAC unit 12 may include one or more heat exchangers across which an air flow is passed to condition the air flow before the air flow is supplied to the building 10. In the illustrated embodiment, the HVAC unit 12 is a rooftop unit (RTU) that conditions a supply air stream, such as environmental air and/or a return air flow from the building 10. After the HVAC unit 12 conditions the air, the air is supplied to the building 10 via ductwork 14 extending throughout the building 10 from the HVAC unit 12. For example, the ductwork 14 may extend to various individual floors or other sections of the building 10. In certain embodiments, the HVAC unit 12 may be a heat pump that provides both heating and cooling to the building 10 with one refrigeration circuit configured to operate in different modes. In other embodiments, the HVAC unit 12 may include one or more refrigeration circuits for cooling an air stream and a furnace for heating the air stream.

The HVAC unit 12 is located on a rooftop of the building 10 in the illustrated embodiment. However, in other embodiments, the HVAC unit 12 may be disposed in different locations (e.g., in a basement or utility room). In order to mitigate the potential for working fluid, such as the refrigerant from the one or more refrigerant circuits referenced above, to escape the HVAC unit 12 via a breach during a damage event, present embodiments include a WFE 17. In the illustrated embodiment, the WFE 17 is positioned above a roofline of the building 10. This encourages elimination of the working fluid at a location that is distant from the building 10 such that any impact to the building 10 caused by such an elimination (e.g., a venting operation) is reduced. However, as noted above, some HVAC systems may be designed or positioned such that this type of arrangement is not practical. For example, an HVAC system may include relevant components in a basement 18 of the building 10, which may benefit from the WFE 17 containing aspects of the refrigerant rather than venting directly to atmosphere. Thus, depending on circumstances, the WFE 17 may be a venting WFE or a containment WFE, in accordance with present embodiments.

A control device 20, one type of which may be a thermostat, may be used to designate the temperature of the conditioned air. The control device 20 also may be used to control the flow of air through the ductwork 14. For example, the control device 20 may be used to regulate operation of one or more components of the HVAC unit 12 or other components, such as dampers and fans, within the building 10 that may control flow of air through and/or from the ductwork 14. In some embodiments, other devices may be included in the system, such as pressure and/or temperature transducers or switches that sense the temperatures and pressures of the supply air, return air, and so forth. Moreover, the control device 20 may include computer systems that are integrated with or separate from other building control or monitoring systems, and even systems that are remote from the building 10. For example, the control device 20 may be a component of a control system 22, which may include or cooperate with an event controller 23 (e.g., a firefighter control panel). The control system 22 may be remote or onsite and may control all aspects (e.g., the event controller 23) of the HVAC unit 12, including standard operations and elimination of working fluid via the WFE 17. The event controller 23 may be a standalone controller or integral with the control system 22 and may allow authorized personnel (e.g., a firefighter or manager) to activate the WFE 17. As with the control system 22, the event controller 23 may be onsite or remote. However, the event controller 23 may benefit from being onsite to allow for physical access by an authorized individual (e.g., a firefighter) that does not have immediate access to a control terminal (e.g., a station in a control room) for the control system 22 or event controller 23. For example, the event controller 23 may include an onsite panel that is physically accessible via a key or a physical actuator that blocks physical access without authorization (e.g., a physical key or a biometric verification). However, the event controller 23 may also or separately include a control component (e.g., a computer or computer portal) that allows control via an authorized login or the like. Regardless of whether remote or local, the event controller 23 blocks unauthorized access but allows access to authorized individuals (e.g., fire department personnel).

Figure 2:
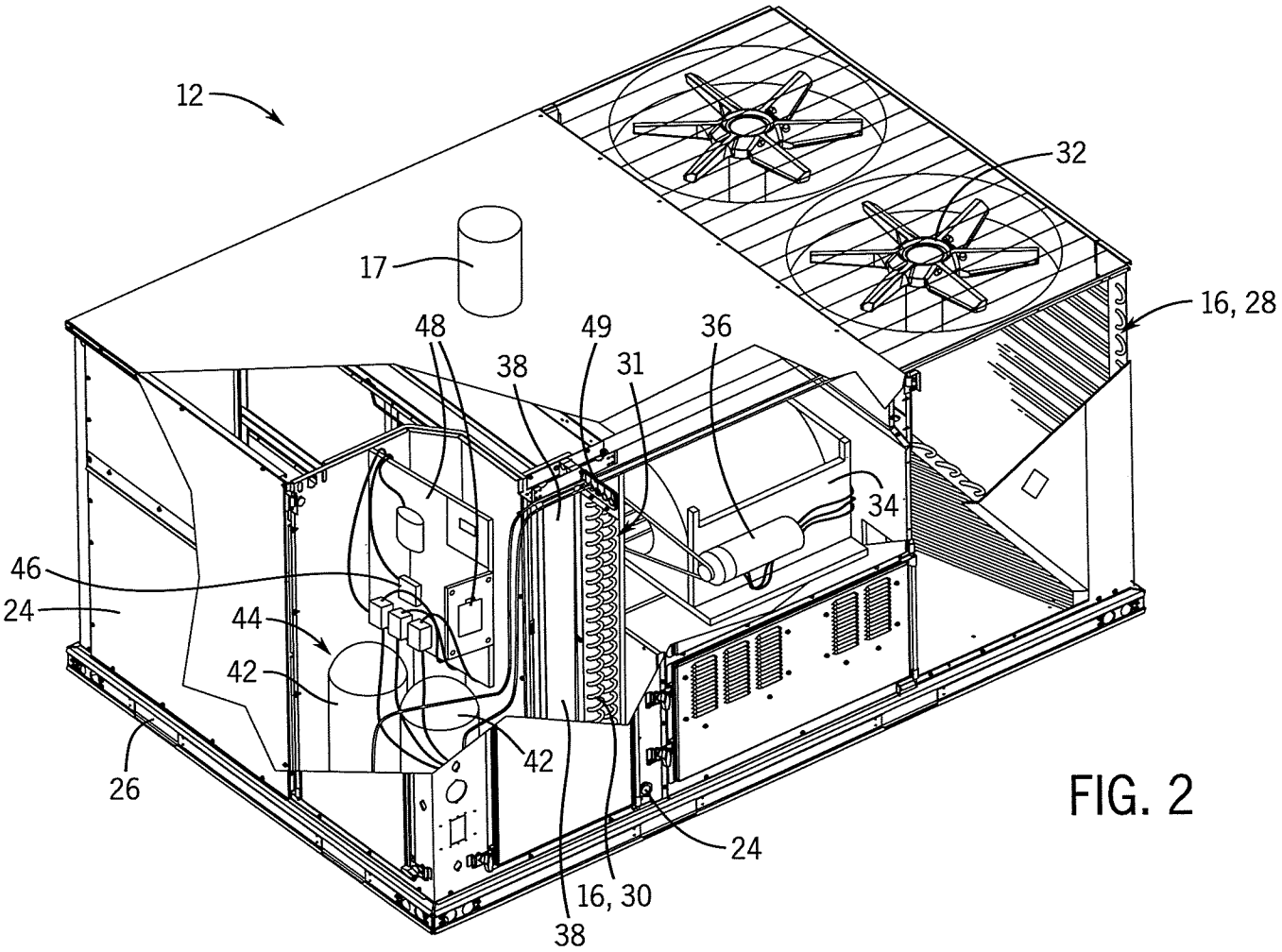
FIG. 2 is a perspective view of an embodiment of a packaged HVAC unit having a working fluid eliminator, in accordance with an aspect of the present disclosure.

FIG. 2 is a perspective view of an embodiment of the HVAC unit 12. In the illustrated embodiment, the HVAC unit 12 is a single package unit that may include one or more independent refrigeration circuits and components that are tested, charged, wired, piped, and ready for installation. The HVAC unit 12 may provide a variety of heating and/or cooling functions, such as cooling only, heating only, cooling with electric heat, cooling with dehumidification, cooling with gas heat, or cooling with a heat pump. As described above, the HVAC unit 12 may directly cool and/or heat an air stream provided to the building 10 to condition a space in the building 10.

As shown in the illustrated embodiment of FIG. 2, a cabinet 24 (e.g., an enclosure) encloses the HVAC unit 12 and provides structural support and protection to the internal components from environmental and other contaminants. In some embodiments, the cabinet 24 may be constructed of galvanized steel and insulated with aluminum foil faced insulation. Rails 26 may be joined to the bottom perimeter of the cabinet 24 and provide a foundation for the HVAC unit 12. In certain embodiments, the rails 26 may provide access for a forklift and/or overhead rigging to facilitate installation and/or removal of the HVAC unit 12. In some embodiments, the rails 26 may fit into "curbs" on the roof to enable the HVAC unit 12 to provide air to the ductwork 14 from the bottom of the HVAC unit 12 while blocking elements such as rain from leaking into the building 10.

The HVAC unit 12 includes heat exchangers 28 and 30 in fluid communication with one or more refrigeration circuits. Either or both of the heat exchangers 28 and/or 30 may include the heat exchanger assembly 16 in accordance with the embodiments discussed herein. Tubes within the heat exchangers 28 and 30 may circulate refrigerant, such as R-410A, through the heat exchangers 28 and 30. The tubes may be of various types, such as multichannel tubes, conventional copper or aluminum tubing, and so forth. Together, the heat exchangers 28 and 30 may implement a thermal cycle in which the refrigerant undergoes phase changes and/or temperature changes as it flows through the heat exchangers 28 and 30 to produce heated and/or cooled air. For example, the heat exchanger 28 may function as a condenser where heat is released from the refrigerant to ambient air, and the heat exchanger 30 may function as an evaporator where the refrigerant absorbs heat to cool an air stream. In other embodiments, the HVAC unit 12 may operate in a heat pump mode where the roles of the heat exchangers 28 and 30 may be reversed. That is, the heat exchanger 28 may function as an evaporator and the heat exchanger 30 may function as a condenser. In further embodiments, the HVAC unit 12 may include a furnace for heating the air stream that is supplied to the building 10. While the illustrated embodiment of FIG. 2 shows the HVAC unit 12 having two of the heat exchangers 28 and 30, in other embodiments, the HVAC unit 12 may include one heat exchanger or more than two heat exchangers.

In the illustrated embodiment, the heat exchanger 30 is located within a compartment 31 that separates the heat exchanger 30 from the heat exchanger 28. Fans 32 draw air from the environment through the heat exchanger 28. Air may be heated and/or cooled as the air flows through the heat exchanger 28 before being released back to the environment surrounding the HVAC unit 12. A blower assembly 34, powered by a motor 36, draws air through the heat exchanger 30 to heat or cool the air. The heated or cooled air may be directed to the building 10 by the ductwork 14, which may be connected to the HVAC unit 12. Before flowing through the heat exchanger 30, the conditioned air may flow through one or more filters 38 that may remove particulates and contaminants from the air. In certain embodiments, the filters 38 may be disposed on the air intake side of the heat exchanger 30 to prevent contaminants from contacting the heat exchanger 30.

The HVAC unit 12 also may include other equipment for implementing the thermal cycle. Compressors 42 increase the pressure and temperature of the refrigerant before the refrigerant enters the heat exchanger 28. The compressors 42 may be any suitable type of compressors, such as scroll compressors, rotary compressors, screw compressors, or reciprocating compressors. In some embodiments, the compressors 42 may include a pair of hermetic direct drive compressors arranged in a dual stage configuration 44. However, in other embodiments, any number of the compressors 42 may be provided to achieve various stages of heating and/or cooling. As may be appreciated, additional equipment and devices may be included in the HVAC unit 12, such as a solid-core filter drier, a drain pan, a disconnect switch, an economizer, pressure switches, phase monitors, and humidity sensors, among other things.

The WFE 17 extends outward from the cabinet 24, which mitigates the potential for accumulation of vented working fluid, combustion products or improperly leaked substances from the WFE 17 within the cabinet 24. However, in some embodiments the WFE 17 (e.g., a containment WFE) may be disposed within the cabinet 24 or extend even further away from the cabinet 24. Further, the WFE 17 is fluidly coupled to the refrigerant circuit of the HVAC unit 12 downstream of the compressors 42 (which may be representative of one or more such compressors in other embodiments). More specifically, the WFE 17 may be in fluid communication with the refrigerant circuit of the HVAC unit 12 (e.g., via a control valve, such as a solenoid valve) between the compressors 42 and the heat exchanger 28 (downstream of the compressors 42 and upstream of the heat exchanger 28). In an embodiment that employs a heat pump, the WFE 17 may be in fluid communication with the refrigerant circuit of the HVAC unit 12 between the compressors 42 and one or both of the heat exchangers 28, 30 such that the access point for the WFE 17 can be downstream of the compressors 42 and upstream of the immediately following (relative to refrigerant flow) heat exchanger 28, 30 in either mode of operation (e.g., cooling or heating). By connecting the WFE 17 to the refrigerant circuit in this way, the WFE 17 is able to operate to vent high pressure refrigerant from the HVAC unit 12 when actuated. With respect to implementation with a heat pump, controls (e.g., the event controller 23) of the HVAC unit 12 may detect a mode of operation of the heat pump and activate the corresponding valve to release the refrigerant that is downstream of the compressors 42 and upstream of the respective heat exchanger 28, 30. In some embodiments, a vent valve for the WFE 17 may be positioned essentially immediately downstream of the compressors 42 (e.g., before a reversing valve) such that there is only one access point even for a heat pump implementation.

The HVAC unit 12 may receive power through a terminal block 46. For example, a high voltage power source may be connected to the terminal block 46 to power the equipment. The operation of the HVAC unit 12 may be governed or regulated by a control board 48. The control board 48 may include control circuitry connected to a thermostat, sensors, and alarms. One or more of these components may be referred to herein separately or collectively as the control device 20. The control circuitry may be configured to control operation of the equipment, provide alarms, and monitor safety switches. Wiring 49 may connect the control board 48 and the terminal block 46 to the equipment of the HVAC unit 12. In some embodiments, the control board 48 may be in communication with or may include the event controller 23.

Figure 3:
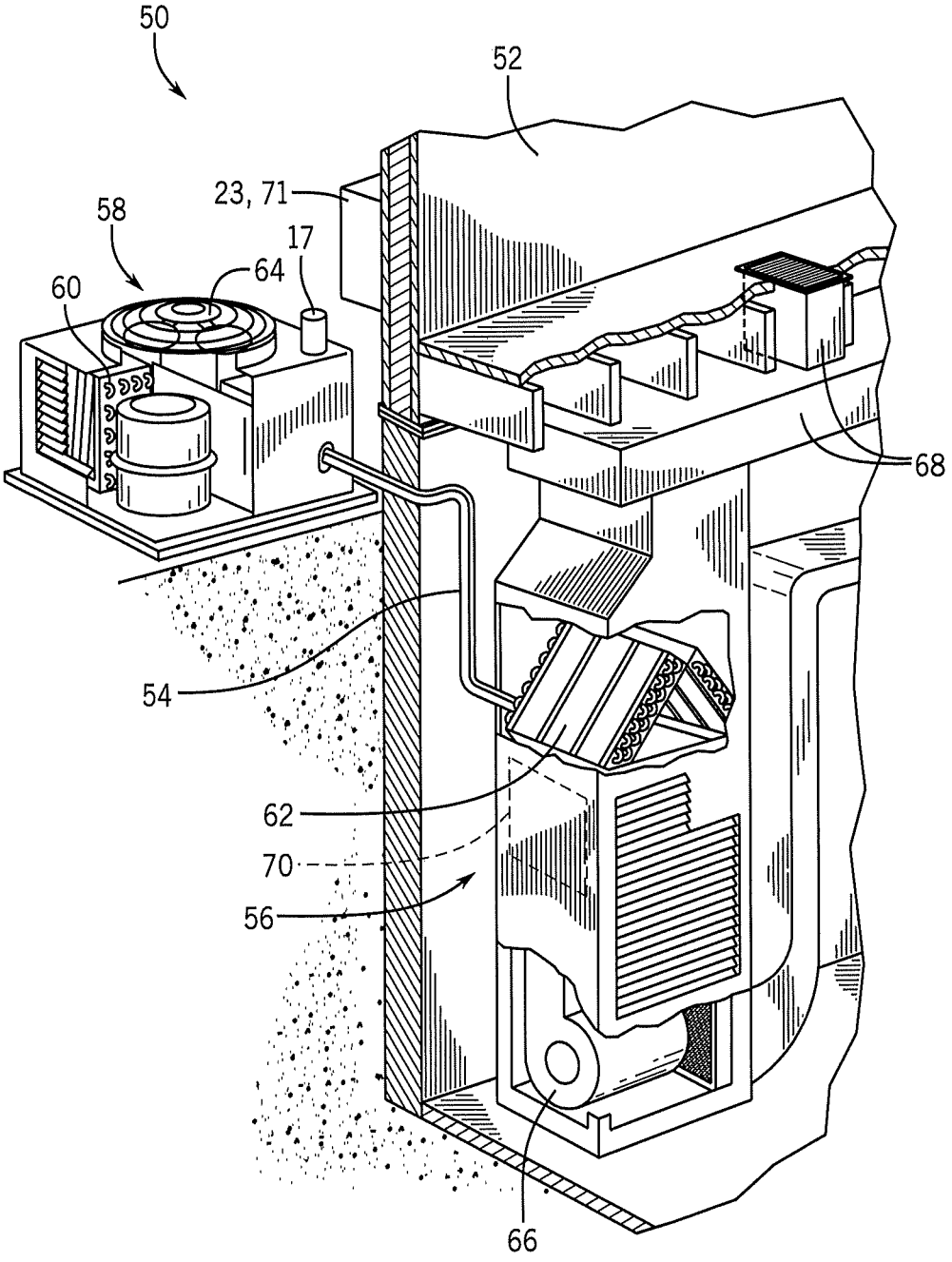
FIG. 3 is a cutaway perspective view of an embodiment of a residential, split HVAC system, in accordance with an aspect of the present disclosure.

FIG. 3 illustrates a residential heating and cooling system 50, also in accordance with present techniques. The residential heating and cooling system 50 may provide heated and cooled air to a residential structure, as well as provide outside air for ventilation and provide improved indoor air quality (IAQ) through devices such as ultraviolet lights and air filters. In the illustrated embodiment, the residential heating and cooling system 50 is a split HVAC system. In general, a residence 52 conditioned by a split HVAC system may include refrigerant conduits 54 that operatively couple the indoor unit 56 to the outdoor unit 58. The indoor unit 56 may be positioned in a utility room, an attic, a basement, and so forth. The outdoor unit 58 is typically situated adjacent to a side of residence 52 and is covered by a shroud to protect the system components and to prevent leaves and other debris or contaminants from entering the unit. The refrigerant conduits 54 transfer refrigerant between the indoor unit 56 and the outdoor unit 58, typically transferring primarily liquid refrigerant in one direction and primarily vaporized refrigerant in an opposite direction.

When the system shown in FIG. 3 is operating as an air conditioner, a heat exchanger 60 in the outdoor unit 58 serves as a condenser for re-condensing vaporized refrigerant flowing from the indoor unit 56 to the outdoor unit 58 via one of the refrigerant conduits 54. In these applications, a heat exchanger 62 of the indoor unit 56 functions as an evaporator. Specifically, the heat exchanger 62 receives liquid refrigerant, which may be expanded by an expansion device, and evaporates the refrigerant before returning it to the outdoor unit 58.

The outdoor unit 58 draws environmental air through the heat exchanger 60 using a fan 64 and expels the air above the outdoor unit 58. When operating as an air conditioner, the air is heated by the heat exchanger 60 within the outdoor unit 58 and exits the unit at a temperature higher than it entered. The indoor unit 56 includes a blower or fan 66 that directs air through or across the indoor heat exchanger 62, where the air is cooled when the system is operating in air conditioning mode. Thereafter, the air is passed through ductwork 68 that directs the air to the residence 52. The overall system operates to maintain a desired temperature as set by a system controller. When the temperature sensed inside the residence 52 is higher than the set point on the thermostat, or a set point plus a small amount, the residential heating and cooling system 50 may become operative to refrigerate additional air for circulation through the residence 52. When the temperature reaches the set point, or a set point minus a small amount, the residential heating and cooling system 50 may stop the refrigeration cycle temporarily.

The residential heating and cooling system 50 may also operate as a heat pump. When operating as a heat pump, the roles of heat exchangers 60 and 62 are reversed. That is, the heat exchanger 60 of the outdoor unit 58 will serve as an evaporator to evaporate refrigerant and thereby cool air entering the outdoor unit 58 as the air passes over outdoor the heat exchanger 60. The indoor heat exchanger 62 will receive a stream of air blown over it and will heat the air by condensing the refrigerant.

In some embodiments, the indoor unit 56 may include a furnace system 70. For example, the indoor unit 56 may include the furnace system 70 when the residential heating and cooling system 50 is not configured to operate as a heat pump. The furnace system 70 may include a burner assembly and heat exchanger, among other components, inside the indoor unit 56. Fuel is provided to the burner assembly of the furnace system 70 where it is mixed with air and combusted to form combustion products. The combustion products may pass through tubes or piping in a heat exchanger, separate from heat exchanger 62, such that air directed by the blower 66 passes over the tubes or pipes and extracts heat from the combustion products. The heated air may then be routed from the furnace system 70 to the ductwork 68 for heating the residence 52.

As with the embodiment described in FIG. 2, the residential heating and cooling system 50 includes the WFE 17, which may be in fluid communication with the refrigerant conduits 54 via one or more valves (e.g., releasers, valves or rupture points) downstream of a compressor of the system and upstream of the relevant heat exchanger 60, 62 depending on mode of operation. In the illustrated embodiment of FIG. 3, the event controller 23, which controls operation of the WFE 17, is illustrated as part of a panel 71 (e.g., a fire control panel, firefighter panel, fire alarm panel) disposed on an exterior of the residence 52. This may facilitate ready access to someone like a firefighter that wishes to make an authorized activation of the WFE 17 from a position outside of the residence 52. The panel 71 may include a locked door that prevents access to the event controller 23 (e.g., a button or switch that activates operation of the WFE 17 to eliminate refrigerant) within a housing of the panel 71 without an appropriate physical entry mechanism (e.g., a key).

Figure 4:
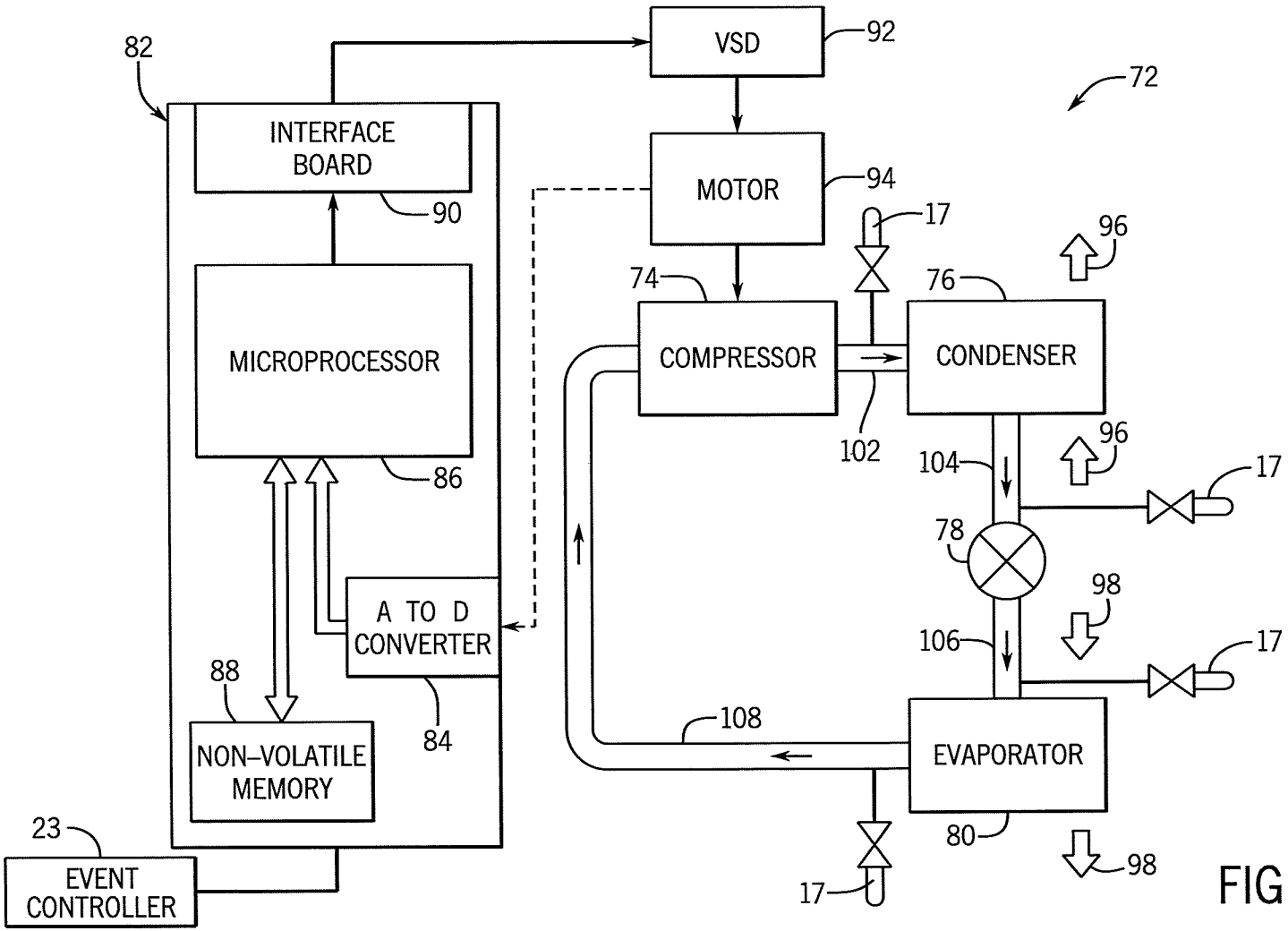
FIG. 4 is a schematic diagram of an embodiment of a vapor compression system incorporating at least one working fluid eliminator, in accordance with an aspect of the present disclosure.

FIG. 4 is an embodiment of a vapor compression system 72 that can be used in any of the systems described above. The vapor compression system 72 may circulate a refrigerant through a circuit starting with a compressor 74. The circuit may also include a condenser 76, an expansion valve(s) or device(s) 78, and an evaporator 80. The vapor compression system 72 may further include a control panel 82 that has an analog to digital (A/D) converter 84, a microprocessor 86, a non-volatile memory 88, and/or an interface board 90. The control panel 82 and its components may function to regulate operation of the vapor compression system 72 based on feedback from an operator, from sensors of the vapor compression system 72 that detect operating conditions, and so forth. The control panel 82 may include or communicate with the event controller 23.

In some embodiments, the vapor compression system 72 may use one or more of a variable speed drive (VSDs) 92, a motor 94, the compressor 74, the condenser 76, the expansion valve or device 78, and/or the evaporator 80. The motor 94 may drive the compressor 74 and may be powered by the variable speed drive (VSD) 92. The VSD 92 receives alternating current (AC) power having a particular fixed line voltage and fixed line frequency from an AC power source, and provides power having a variable voltage and frequency to the motor 94. In other embodiments, the motor 94 may be powered directly from an AC or direct current (DC) power source. The motor 94 may include any type of electric motor that can be powered by a VSD or directly from an AC or DC power source, such as a switched reluctance motor, an induction motor, an electronically commutated permanent magnet motor, or another suitable motor.

The compressor 74 (which may represent multiple compressors) compresses a refrigerant vapor and delivers the vapor to the condenser 76 through a discharge passage. In some embodiments, the compressor 74 may be a centrifugal compressor. The refrigerant vapor delivered by the compressor 74 to the condenser 76 may transfer heat to a fluid passing across the condenser 76, such as ambient or environmental air 96. The refrigerant vapor may condense to a refrigerant liquid in the condenser 76 as a result of thermal heat transfer with the environmental air 96. The liquid refrigerant from the condenser 76 may flow through the expansion device 78 to the evaporator 80.

The liquid refrigerant delivered to the evaporator 80 may absorb heat from another air stream, such as a supply air stream 98 provided to the building 10 or the residence 52. For example, the supply air stream 98 may include ambient or environmental air, return air from a building, or a combination of the two. The liquid refrigerant in the evaporator 80 may undergo a phase change from the liquid refrigerant to a refrigerant vapor. In this manner, the evaporator 80 may reduce the temperature of the supply air stream 98 via thermal heat transfer with the refrigerant. Thereafter, the vapor refrigerant exits the evaporator 80 and returns to the compressor 74 by a suction line to complete the cycle.

In some embodiments, the vapor compression system 72 may further include a reheat coil in addition to the evaporator 80. For example, the reheat coil may be positioned downstream of the evaporator relative to the supply air stream 98 and may reheat the supply air stream 98 when the supply air stream 98 is overcooled to remove humidity from the supply air stream 98 before the supply air stream 98 is directed to the building 10 or the residence 52.

The vapor compression system 72 also includes one or more WFEs 17, each of which may be representative of multiple WFEs 17 coordinating together. For example a WFE 17 is illustrated as fluidly coupled to a refrigerant line 102 extending between the compressor 74 (which may represent a bank of compressors) and the condenser 76 (which may represent multiple heat exchangers). By positioning the WFE 17 along the refrigerant line 102, an elimination event (elimination of refrigerant via the WFE 17) will benefit from a high differential pressure between the refrigerant (working fluid) and atmosphere or other lower pressure system (e.g., a containment vessel), which facilitates rapid and thorough release of the refrigerant (e.g., as a vapor). The WFE 17 in fluid communication with refrigerant line 102 may be a venting WFE that directly expels refrigerant (e.g., to atmosphere) but may also be a containment WFE (e.g., when the positioning of the WFE 17 is inside a structure) or a combination of operational types. Other WFEs 17 are illustrated along refrigerant line 104 (extending between the condenser 76 and the expansion valve 78), refrigerant line 106 (extending between the expansion valve 78 and the evaporator 80), and the refrigerant line 108 (extending between the evaporator 80 and the compressor 74). The WFEs 17 illustrated on refrigerant lines 104, 106, and 108 may be containment WFEs or venting WFEs, depending on surrounding circumstances, and associated functionality as discussed above. Each of the illustrated WFEs 17 may function separately or together in any combination. It should be noted that while multiple WFEs 17 are shown for illustrative purposes, it should be understood that each illustrated WFE 17 in FIG. 4 may be employed alone without any of the others operating or even being present. Further, each illustrated WFE 17 may coordinate with any other WFE 17 in any possible combination.

It should be appreciated that any of the features described herein may be incorporated with the HVAC unit 12, the residential heating and cooling system 50, or other HVAC systems. Additionally, while the features disclosed herein are described in the context of embodiments that directly heat and cool a supply air stream provided to a building or other load, embodiments of the present disclosure may be applicable to other HVAC systems as well. For example, the features described herein may be applied to mechanical cooling systems, free cooling systems, chiller systems, or other heat pump or refrigeration applications.

Figure 5:
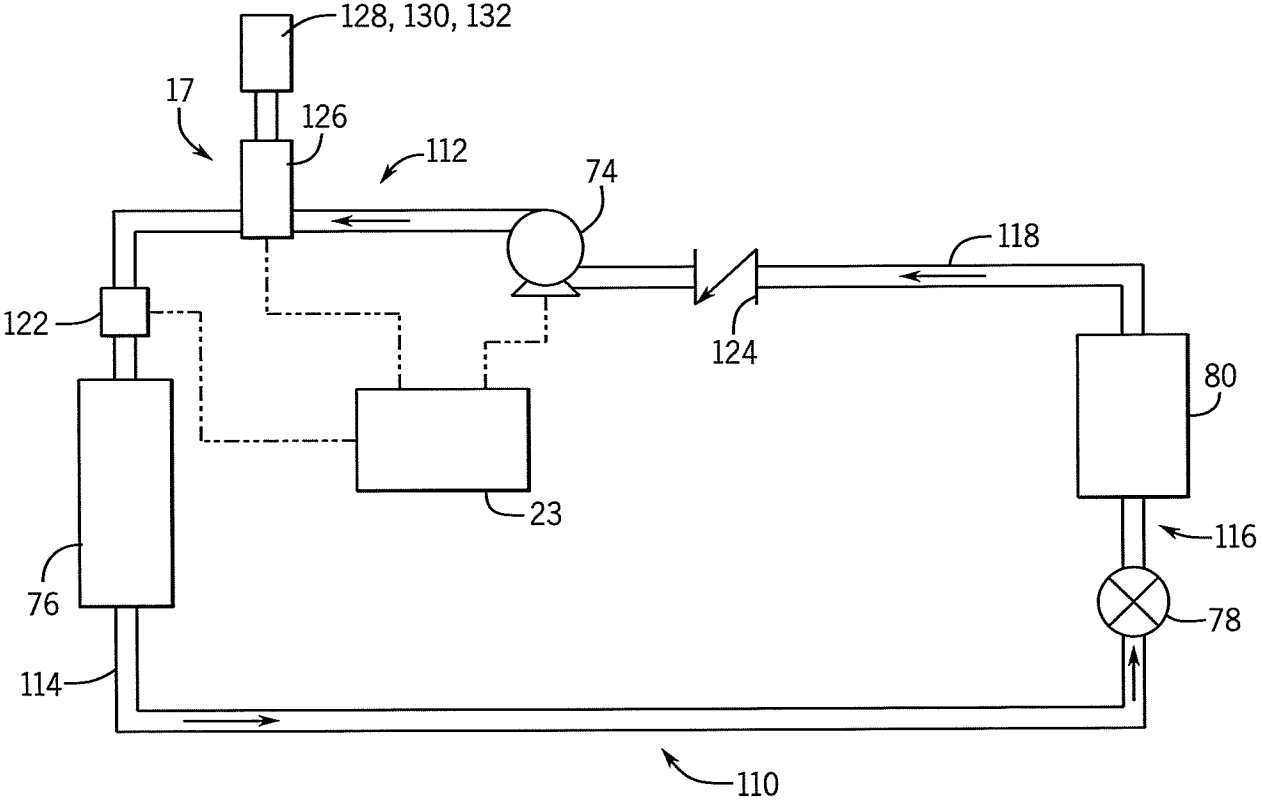
FIG. 5 is a schematic diagram of an embodiment of a vapor compression system including a venting, combusting, diluting, and/or inactivating working fluid eliminator, in accordance with an aspect of the present disclosure.

FIG. 5 is a schematic diagram of aspects of the vapor compression system 72 including the WFE 17, which may be a venting, combusting, diluting, and/or inactivating WFE, in accordance with aspects of the present disclosure. Specifically, the embodiment illustrated in FIG. 5 includes a refrigerant circuit 110 with a hot gas section 112 downstream of the compressor 74 and upstream of the condenser 76, a liquid section 114 downstream of the condenser 76 and upstream of the expansion device 78, an expanding section 116 downstream of the expansion device 78 and upstream of the evaporator 80, and a suction section 118 downstream of the evaporator 80 and upstream of the compressor 74. These sections 112, 114, 116, 118 are referred to by names associated with the refrigerant stage passing therethrough. However, this terminology is for reference purposes and it should be understood that certain stages of the refrigerant may vary within the various portions of the refrigerant circuit 110. For example, the liquid section 114 may not always or only contain liquid refrigerant.

As illustrated in FIG. 5, the event controller 23 may be communicatively coupled (directly or indirectly) to the WFE 17, the compressor 74, and a blocking valve (blocking control valve) 122 downstream of the WFE 17. In the illustrated embodiment, the blocking valve 122 is positioned in the hot gas section 112. However, in other embodiments, the blocking valve 122 maybe be positioned in the liquid section 114, the expanding section 116, or even the suction section 118. When operating to eliminate working fluid (e.g., the refrigerant), the event controller 23 may keep the compressor 74 operating while opening flow to the WFE 17 (e.g., via a valve of the WFE 17) and closing flow through the blocking valve 122. However, in other embodiments, a pressure differential between the vapor compression system 72 and the ambient environment may be sufficient to eliminate the working fluid from the vapor compression system 72 without operating the compressor 74. Further, a check valve 124 or other directional flow control may operate to limit flow (e.g., backflow) of the working fluid in a direction of the compressor 74 in the suction section 118. In conjunction, these various components and operations may force the working fluid toward the WFE 17. Also, these operations and components may push the working fluid to an outside portion (e.g., external to a building being conditioned by the vapor compression system 72) of the vapor compression system 72, which can be beneficial for accidental or intentional release of the working fluid. The WFE 17 may include a valve, such as a control valve 126 (or other portal control mechanism) that may be controlled to be fully open to vent a maximum rate of working fluid to a secondary portion 128 of the WFE 17, which may include a vent guide 130, a containment vessel 132, or both. When the secondary portion 128 of the WFE 17 is the vent guide 130, it may be desirable for the valve 126 to open fully during a working fluid elimination operation. However, when the secondary portion 128 of the WFE 17 includes the containment vessel 132 (e.g., for burning, diluting, and/or deactivating), it may be desirable to throttle the valve 126 to control ratios (e.g., of refrigerant to air, refrigerant to deactivation fluid, and/or refrigerant to diluent) for ignition, mixing, and so forth.

Figure 6:
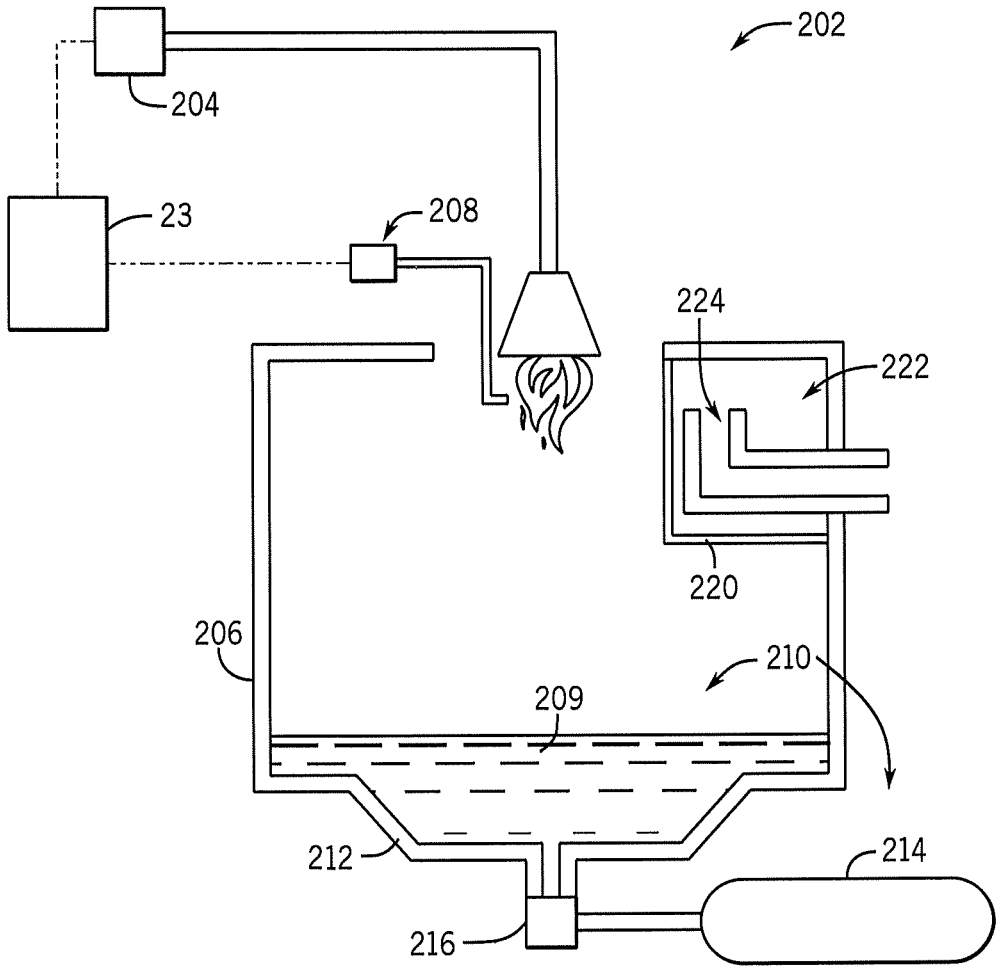
FIG. 6 is a schematic cross-sectional view of an embodiment of a combusting working fluid eliminator, in accordance with an aspect of the present disclosure.

FIG. 6 is a schematic cross-sectional view of an embodiment of a combusting WFE 202, in accordance with an aspect of the present disclosure. The combusting WFE 202 is configured to receive working fluid from a vapor compression circuit 204 (e.g., the refrigerant circuit 110) and direct the working fluid into a containment vessel 206. An igniter 208 may be controlled by the event controller 23 to provide ignition (e.g., via a pilot flame, spark, heat) to initiate combustion of the working fluid as it enters the containment vessel 206. That is, the event controller 23 may be configured to operate the igniter 208 based on transition of a valve (e.g., control valve 126) from a closed position to an open position. In some embodiments, the igniter 208, which may include multiple components and feeds, may provide oxygen (via provision of air) to facilitate combustion of the working fluid. In some embodiments, the combusting WFE 202 is configured such that a Venturi effect pulls air into the containment vessel 206 to facilitate combustion.

Combustion of the working fluid in the containment vessel 206 may result in off-gassing and other residue, such as liquid and solid combustion products. Some of these combustion products 209 may accumulate in a waste collection reservoir 210. The waste collection reservoir 210 may be part of the containment vessel 206 and/or coupled to the containment vessel 206. For example, in the illustrated embodiment, the waste collection reservoir 210 includes a base or recess 212 of the containment vessel 206 and a separate collection vessel 214. In some embodiments, the separate collection vessel 214 may be coupled to or include a suction mechanism 216 (e.g., a pump) that pulls any waste (e.g., the combustion products 209) into the separate collection vessel 214 so that the separate collection vessel 214 can be filled with the waste, disconnected from the rest of the WFE 202 and disposed of or recycled. Any gas or vapor that is released or pushed out of the containment vessel 206 may pass through a filter (e.g., a wire mesh or fine filter) 220 and to a venting mechanism 222. The venting mechanism 222 may be oriented with an upward facing input port 224 to discourage solid and liquids from escaping via the venting mechanism 222.

Figure 7:
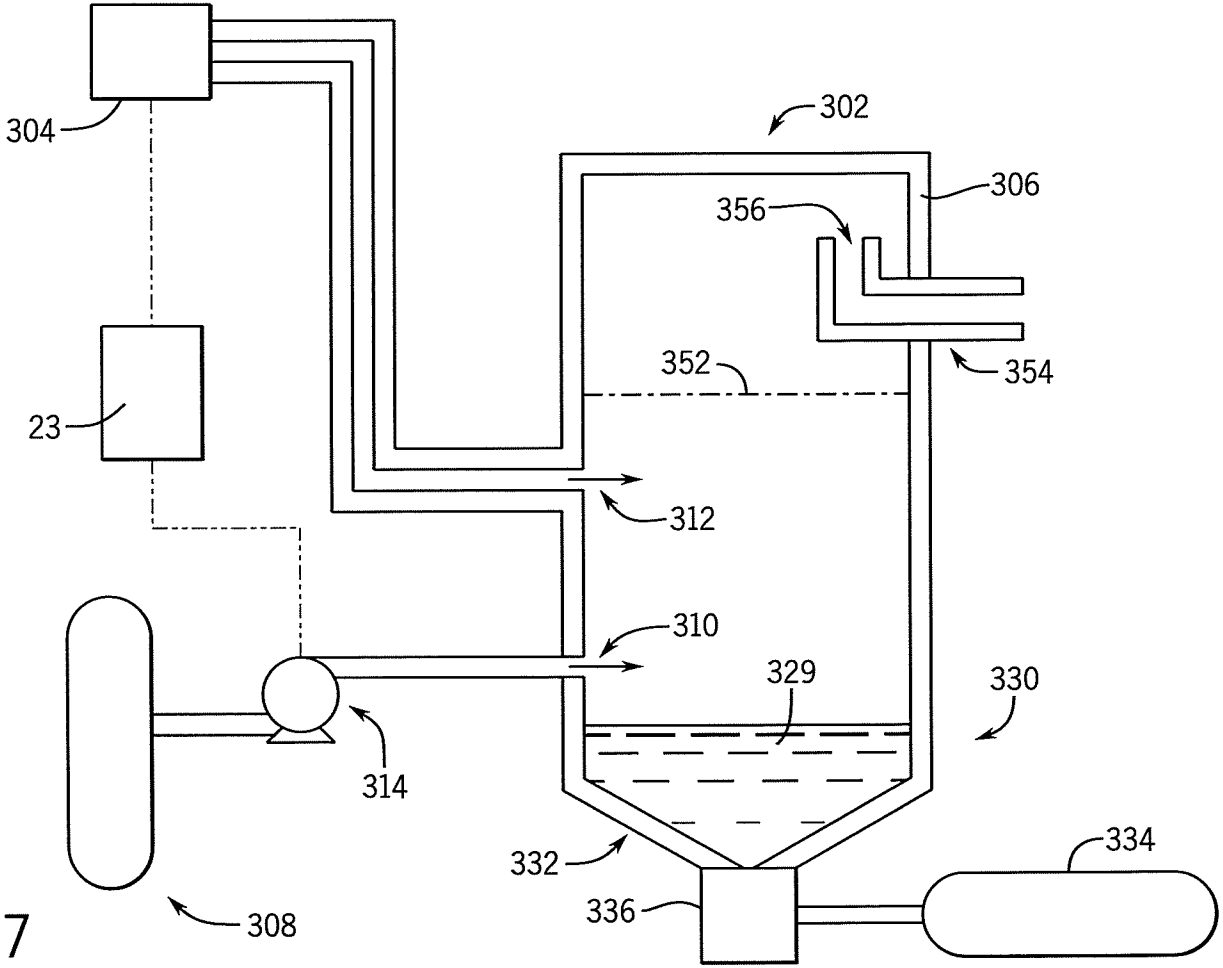
FIG. 7 is a schematic cross-sectional view of an embodiment of a diluting and/or inactivating working fluid eliminator, in accordance with an aspect of the present disclosure.

FIG. 7 is a schematic cross-sectional view of an embodiment of a diluting WFE 302 (e.g., containment WFE, inactivating WFE) configured to receive working fluid from a vapor compression circuit 304 (e.g., the refrigerant circuit 110) and direct the working fluid into a containment vessel 306. A dilutive and/or reactive fluid supply system (fluid supply system) 308 may be controlled by the event controller 23 to direct one or more flows of dilutive and/or reactive fluid into the containment vessel 306 along with the working fluid from the vapor compression circuit 304 being delivered into the containment vessel 306. In some embodiments, entry ports into the containment vessel 306 may be arranged such that the dilutive and/or reactive fluid (e.g., reactive with the working fluid such that properties of the working fluid change) enters the containment vessel 306 in a manner that causes added mixing. For example, an entry port 310 into the containment vessel 306 from the fluid supply system 308 is positioned below (with respect to gravity) an entry port 312 into the containment vessel 306 from the vapor compression circuit 304, in the illustrated embodiment, which may facilitate mixing. However, in other embodiments, properties of the various fluids (including the working fluid) may benefit from different arrangements. For example, the entry ports 310, 312 may be arranged to face each other, face the same direction (as shown), flow into the containment vessel 306 from a top or bottom, or the like. In one embodiment, the containment vessel 306 may already include a diluting and/or deactivating fluid (which may be supplied from the fluid supply system 308 just prior to receiving the working fluid) and the entry port 312 may be positioned to cause the working fluid to pass through (bubble through) the accumulated diluting and/or deactivating fluid. The fluid supply system 308 may supply the dilutive and/or deactivating fluid to the containment vessel 306 via a flow component 314 (e.g., a pump or control valve). In some embodiments, the flow component 314 is a pump controlled by the event controller 23 and/or a control valve (e.g., in a gravity feed arrangement) controlled by the event controller 23. The diluting and/or deactivating fluid may include any of various different types of fluid. Depending on the nature of the working fluid being eliminated, different chemicals may be used.

Deactivation of the working fluid in the containment vessel 306 will include a chemical reaction and may result in off-gassing and other residue, such as liquid and solid reaction byproducts. Some of these byproducts 329 may accumulate in a waste collection reservoir 330. The waste collection reservoir 330 may be part of the containment vessel 306 and/or coupled to the containment vessel 306. For example, in the illustrated embodiment, the waste collection reservoir 330 includes a base or recess 332 of the containment vessel 306 and a separate collection vessel 334. In some embodiments, the separate collection vessel may be coupled to or include a suction mechanism (e.g., a pump) 336 that pulls any waste (e.g., the byproducts 329) into the separate collection vessel 334 so that the separate collection vessel 334 can be filled with the waste, disconnected from the rest of the WFE 302 and disposed of or recycled. Any gas or vapor that is released or pushed out of the containment vessel 306 may pass through a filter (e.g., a wire mesh or fine filter) 352 and to a venting mechanism 354. The venting mechanism 354 may be oriented with an upward facing input port 356 to discourage solids and liquids from escaping via the venting mechanism 354.

Figure 8:
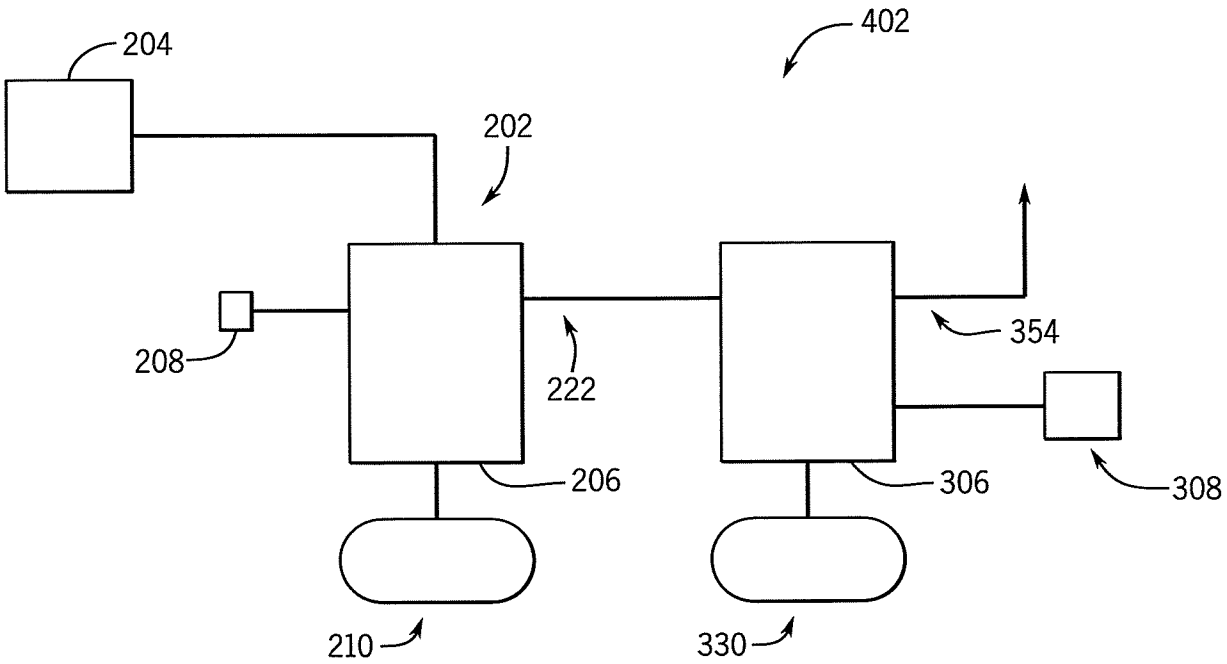
FIG. 8 is a schematic view of an embodiment of a combusting working fluid eliminator in series with a downstream treatment system, in accordance with an aspect of the present disclosure.

FIG. 8 is a schematic view of an embodiment of the combusting WFE 202 in series with a downstream treatment system 402, in accordance with an aspect of the present disclosure. As noted above, combinations of WFEs 17 may be employed as single WFEs 17 and/or multiple WFEs 17 may coordinate together. In the embodiment illustrated by FIG. 8, the combusting WFE 202 may expel or vent to another WFE 17 operating as the downstream treatment system 402. For example, the downstream treatment system 402 may be a diluting and/or deactivating WFE, such as the WFE 302. This may be beneficial because various stages of elimination may be preferred for certain working fluids (e.g., refrigerants). In still other embodiments, the downstream treatment system 402 may be a simple scrubber or filter system.

As set forth above, embodiments of the present disclosure may provide one or more technical effects useful for manufacture and assembly of a bent, multi-slab heat exchanger assembly that has an enhanced heat transfer capacity and reduced overall exterior length as compared to a linear heat exchanger assembly. The technical effects and technical problems in the specification are examples and are not limiting. It should be noted that the embodiments described in the specification may have other technical effects and can solve other technical problems.

While only certain features and embodiments have been illustrated and described, many modifications and changes may occur to those skilled in the art, such as variations in sizes, dimensions, structures, shapes and proportions of the various elements, values of parameters, such as temperatures and pressures, mounting arrangements, use of materials, colors, orientations, and so forth, without materially departing from the novel teachings and advantages of the subject matter recited in the claims. The order or sequence of any process or method steps may be varied or re-sequenced according to alternative embodiments. It is, therefore, to be understood that the appended claims are intended to cover all such modifications and changes as fall within the true spirit of the disclosure.

Furthermore, in an effort to provide a concise description of the exemplary embodiments, all features of an actual implementation may not have been described, such as those unrelated to the presently contemplated best mode, or those unrelated to enablement. It should be appreciated that in the development of any such actual implementation, as in any engineering or design project, numerous implementation specific decisions may be made. Such a development effort might be complex and time consuming, but would nevertheless be a routine undertaking of design, fabrication, and manufacture for those of ordinary skill having the benefit of this disclosure, without undue experimentation.

The techniques presented and claimed herein are referenced and applied to material objects and concrete examples of a practical nature that demonstrably improve the present technical field and, as such, are not abstract, intangible or purely theoretical. Further, if any claims appended to the end of this specification contain one or more elements designated as "means for [perform]ing [a function] . . . " or "step for [perform]ing [a function] . . . ", it is intended that such elements are to be interpreted under 35 U.S.C. 112(f). However, for any claims containing elements designated in any other manner, it is intended that such elements are not to be interpreted under 35 U.S.C. 112(f).

The invention claimed is:

1. A heating, ventilation, and air conditioning (HVAC) system, comprising:

a vapor compression circuit configured to circulate a working fluid therethrough to condition a fluid in thermal communication with the vapor compression circuit;

a working fluid eliminator fluidly coupled to the vapor compression circuit, wherein the working fluid eliminator comprises a burner configured to ignite the working fluid; and a valve of the working fluid eliminator, wherein the valve is adjustable to enable discharge of the working fluid from the vapor compression circuit and through the working fluid eliminator, wherein the valve is communicatively coupled to and controlled by an event controller.

2. The HVAC system of claim 1, wherein the vapor compression circuit comprises a compressor and a heat exchanger downstream of the compressor relative to a flow direction of the working fluid through the vapor compression circuit, and wherein the working fluid eliminator is fluidly coupled to the vapor compression circuit downstream of the compressor and upstream of the heat exchanger relative to the flow direction.

3. The HVAC system of claim 1, wherein the vapor compression circuit comprises a refrigerant circuit configured to circulate refrigerant as the working fluid, the vapor compression circuit comprising a compressor configured to drive the refrigerant such that the refrigerant flows from the compressor into a condenser, from the condenser to an expansion device, from the expansion device to an evaporator, and from the evaporator to a suction side of the compressor.

4. The HVAC system of claim 3, wherein the working fluid eliminator is fluidly coupled to the refrigerant circuit downstream of the compressor and upstream of the condenser.

5. The HVAC system of claim 3, wherein the working fluid eliminator is fluidly coupled to the refrigerant circuit downstream of the compressor and upstream of the condenser, and wherein the working fluid eliminator comprises a containment working fluid eliminator that includes a vessel, the burner disposed within the vessel, and a venting mechanism to release gaseous combustion products.

6. The HVAC system of claim 1, wherein the valve comprises a control valve or actuation port configured to be operated by the event controller.

7. The HVAC system of claim 1, wherein the working fluid eliminator comprises a containment working fluid eliminator comprising:

a conduit extending from the vapor compression circuit; and a container, wherein the conduit extends from the vapor compression circuit into the container, and wherein the burner is disposed within the container.

8. The HVAC system of claim 1, wherein the burner is communicatively coupled to the event controller, and the event controller is configured to operate the burner based on transition of the valve from a closed position toward an open position.

9. The HVAC system of claim 1, wherein the event controller comprises a firefighter control panel and the valve comprises a control valve.

10. The HVAC system of claim 1, comprising the event controller including a firefighter control panel that blocks unauthorized access via a lock or access control, wherein the firefighter control panel is configured to instruct the valve to transition from a closed position to an open position in response to a manual user input.

11. The HVAC system of claim 1, wherein:

the vapor compression circuit comprises a refrigerant circuit configured to circulate refrigerant as the working fluid;

the vapor compression circuit comprises a compressor configured to drive the refrigerant such that the refrigerant flows from the compressor into a condenser, from the condenser to an expansion device, from the expansion device to an evaporator, and from the evaporator to a suction side of the compressor; and a blocking control valve downstream of the working fluid eliminator and upstream of the suction side of the compressor, the blocking control valve configured to be controlled by the event controller to close off flow of the refrigerant in conjunction with opening the valve.

12. The HVAC system of claim 11, comprising a check valve disposed between the evaporator and the suction side of the compressor to block backflow from the compressor to the evaporator.

13. A heating, ventilation, and air conditioning (HVAC) system, comprising:

a vapor compression circuit configured to circulate a working fluid therethrough to condition a fluid in thermal communication with the vapor compression circuit;

a compressor and a heat exchanger of the vapor compression circuit, the heat exchanger positioned downstream of the compressor relative to a flow direction of the working fluid through the vapor compression circuit; and a working fluid eliminator fluidly coupled to the vapor compression circuit downstream of the compressor and upstream of the heat exchanger relative to the flow direction, wherein the working fluid eliminator comprises an igniter configured to ignite the working fluid.

14. The HVAC system of claim 13, comprising an event controller configured to control a valve of the working fluid eliminator.

15. The HVAC system of claim 13, comprising:

a blocking control valve in the vapor compression circuit downstream of the working fluid eliminator;

a control valve of the working fluid eliminator; and an event controller, wherein the event controller is configured to close the blocking control valve and open the control valve of the working fluid eliminator in conjunction to eliminate the working fluid from the vapor compression circuit.

16. The HVAC system of claim 13, comprising:

an event controller configured to operate the igniter; and a containment vessel of the working fluid eliminator configured to receive the working fluid from the vapor compression circuit, wherein the igniter is disposed within the containment vessel.

17. The HVAC system of claim 13, comprising an event controller configured to control the working fluid eliminator, wherein the working fluid eliminator comprises a containment working fluid eliminator and wherein the HVAC system further comprises a venting working fluid eliminator controlled by the event controller and coupled to a section of the vapor compression circuit downstream of the heat exchanger and upstream of the compressor.

18. A heating, ventilation, and air conditioning (HVAC) system, comprising:

a vapor compression circuit configured to circulate a working fluid therethrough to condition a fluid in thermal communication with the vapor compression circuit;

a working fluid eliminator fluidly coupled to the vapor compression circuit;

a valve of the working fluid eliminator, wherein the valve is adjustable to enable discharge of the working fluid from the vapor compression circuit and through the working fluid eliminator; and an event controller communicatively coupled to the valve and configured to control the valve, wherein the event controller comprises a firefighter control panel that blocks unauthorized access via a lock or access control, wherein the firefighter control panel is configured to instruct the valve to transition from a closed position to an open position in response to a manual user input.

19. The HVAC system of claim 18, wherein the working fluid eliminator comprises a venting working fluid eliminator configured to vent the working fluid to atmosphere above a roofline of a building when the working fluid eliminator is active.

20. The HVAC system of claim 18, comprising:

a containment vessel of the working fluid eliminator configured to receive the working fluid from the vapor compression circuit; and a fluid supply system configured to be operated by the event controller to flow a fluid into the containment vessel in conjunction with the working fluid to dilute and/or deactivate the working fluid.

* * * * *